US006422555B1

(12) United States Patent
Cruz et al.

(10) Patent No.: US 6,422,555 B1
(45) Date of Patent: Jul. 23, 2002

(54) SHEET MATERIAL REGISTRATION APPARATUS AND METHOD

(75) Inventors: Israel Cruz; Maximo Gayoso, both of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/801,015

(22) Filed: Mar. 6, 2001

(51) Int. Cl.[7] ..... B65H 9/16
(52) U.S. Cl. ..... 271/250; 271/314; 271/236
(58) Field of Search ..... 271/250, 251, 271/314, 207, 220, 236

(56) References Cited

U.S. PATENT DOCUMENTS

| | | | | | |
|---|---|---|---|---|---|
| 3,796,153 | A | * | 3/1974 | Jaffa | 101/120 |
| 4,483,530 | A | * | 11/1984 | Spencer et al. | 271/251 |
| 4,546,964 | A | * | 10/1985 | Linthout | 271/251 |
| 4,589,654 | A | * | 5/1986 | Kanoto | 271/314 |
| 5,967,511 | A | * | 10/1999 | Bell | 271/251 |
| 6,164,643 | A | * | 12/2000 | Otsuka | 271/251 |

FOREIGN PATENT DOCUMENTS

| | | | | |
|---|---|---|---|---|
| JP | 00123584 | * | 1/1982 | 271/251 |

* cited by examiner

*Primary Examiner*—H. Grant Skaggs

(57) ABSTRACT

An imaging system includes a roller assembly adapted to guide sheet material in the system into an accumulator, a sheet registration assembly. The registration assembly includes a lateral fence extending along a first edge of the accumulator. The lateral fence is adapted to contact a lateral edge of sheets fed into the accumulator. A longitudinal fence extends along a second edge of the accumulator. The longitudinal fence is adapted to contact a longitudinal edge of sheets fed into the accumulator. A helical registration member is mounted in contact with sheet material entering the accumulator and, is adapted for rotation with the roller assembly. Rotation of the helical registration member with the roller assembly causes the helical registration member to exert a force to urge each sheet of material entering the accumulator toward the lateral fence and the longitudinal fence of the accumulator. In an embodiment, the roller assembly includes a selectively rotating shaft, and the helical registration member is mounted on the shaft. The helical registration member can include a cylindrical core member, with a helical contact surface extending radially from the cylindrical core member. The helical registration member can be fabricated from an elastomeric material, such as urethane. The helical contact surface can be provided as a plurality of part-helical contact sections. In an embodiment, the part-helical contact sections comprise a plurality of radially extending fingers aligned in a spiral around the cylindrical core. A method of improving sheet registration in an imaging system including a roller assembly adapted to feed sheet material in the system into an accumulator is also provided. In a first step, a lateral fence is provided extending along a first edge of the accumulator. A longitudinal fence is provided extending along a second edge of the accumulator, the longitudinal fence being substantially perpendicular to the lateral fence. A helical registration member is mounted for rotation with the roller assembly, in contact with sheet material entering the accumulator. When roller assembly feeds individual sheets of sheet material to the accumulator, the helical registration member rotates with the roller assembly, exerting a force to urge each sheet of material entering the accumulator toward the lateral and longitudinal fences.

17 Claims, 3 Drawing Sheets

SHEET MATERIAL REGISTRATION APPARATUS AND METHOD

FIELD OF THE INVENTION

The present invention relates generally to imaging systems with accumulators. Specifically, the present invention relates to improving registration of sheets gathered in accumulators of imaging systems.

BACKGROUND OF THE INVENTION

Imaging systems such as printers, fax machines, scanners, and copiers are virtually omnipresent, and can be found in homes and offices worldwide. The development of such systems has facilitated improvements in communication that have in turn fostered a sea change in the way people live and work. Telecommuting, paperless offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which sheet material must be infed, moved through the imaging process, and outfed in a matter of seconds, or fractions of a second. The challenge is further complicated by the fact that humans are operating the system, thus introducing the factor of operator error as a source of problems.

During operation of such imaging systems, it is typical for a plurality of sheets to be gathered together at a processing station commonly called an "accumulator". As the sheets are fed individually into the accumulator, slight differences in sheet sizes, weight, thickness, and/or surface textures can cause misalignment, or improper registration, between sheets in the accumulated stack. For each combination of these factors, successful transportation and registration of sheet material depends upon applying the proper amount of applied force on the sheet with a feed mechanism such as a roller.

It is not unusual for sheets handled by feed mechanisms to be at least somewhat out of registration. Consequently, the art reflects mechanisms known as "joggers" to improve registration in the accumulator itself. A typical jogger arrangement is discussed in U.S. Pat. No. 5,072,920 to Kubota et al. This patent is directed to a finisher for an image forming apparatus for stapling or otherwise finishing paper sheets which are sequentially driven out of an image forming apparatus such as a copier or a printer. The finisher is capable of stapling a stack of paper sheets at any desired position or positions of the sack. A pair of reference fences and a pair of jogger fences are provided on a paper receiver for positioning paper sheets in an intended direction of paper transport and a direction perpendicular thereto, respectively. The reference fences and the jogger fences are reciprocatingly movable in a predetermined direction independently of each other, and each is movable in a symmetrical relation. The jogger fences move independently of a stapler, while the reference fences move along with the stapler by being connected to latter.

While known mechanisms are reasonably effective in improving sheet registration, they are accompanied by several drawbacks. For example, joggers usually require additional motors or transmissions, adding to the cost and complexity of the system. Increased complexity frequently means increased service costs and decreased reliability.

It can thus be seen that the need exists for simple, inexpensive, sheet registration mechanism in imaging systems having accumulators.

SUMMARY OF THE INVENTION

These and other objects are achieved by providing, in an imaging system including a roller assembly adapted to guide sheet material in the system into an accumulator, a sheet registration assembly. The registration assembly includes a lateral fence extending along a first edge of the accumulator. The lateral fence is adapted to contact a lateral edge of sheets fed into the accumulator. A longitudinal fence extends along a second edge of the accumulator. The longitudinal fence is adapted to contact a longitudinal edge of sheets fed into the accumulator. A helical registration member is mounted in contact with sheet material entering the accumulator and, is adapted for rotation with the roller assembly. Rotation of the helical registration member with the roller assembly causes the helical registration member to exert a force to urge each sheet of material entering the accumulator toward the lateral fence and the longitudinal fence of the accumulator.

In an embodiment, the roller assembly includes a selectively rotating shaft, and the helical registration member is mounted on the shaft. The helical registration member can include a cylindrical core member, with a helical contact surface extending radially from the cylindrical core member. The helical registration member can be fabricated from an elastomeric material, such as urethane.

The helical contact surface can be provided as a plurality of part-helical contact sections. In an embodiment, the part-helical contact sections comprise a plurality of radially extending fingers aligned in a spiral around the cylindrical core.

A method of improving sheet registration in an imaging system including a roller assembly adapted to feed sheet material in the system into an accumulator is also provided. In a first step, a lateral fence is provided extending along a first edge of the accumulator. A longitudinal fence is provided extending along a second edge of the accumulator, the longitudinal fence being substantially perpendicular to the lateral fence. A helical registration member is mounted for rotation with the roller assembly, in contact with sheet material entering the accumulator. When roller assembly feeds individual sheets of sheet material to the accumulator, the helical registration member rotates with the roller assembly, thereby causing the helical registration member to exert a force to urge each sheet of material entering the accumulator toward the lateral fence and the longitudinal fence of the accumulator.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE INVENTION

Figure 1:
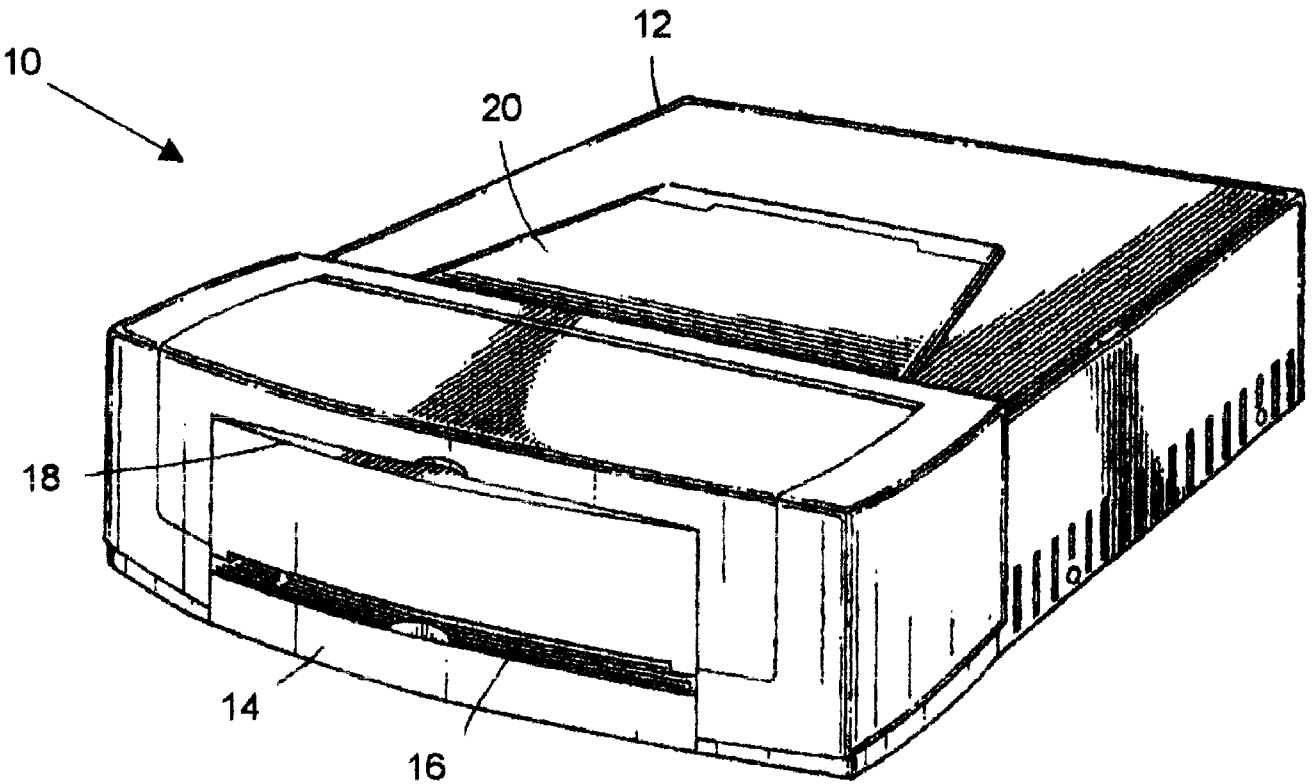
FIG. 1 is a schematic illustration of an imaging system having a registration assembly in accordance with the principles discussed herein.

An imaging system 10 in accordance with the principles of the present invention is illustrated in FIG. 1. Although the present invention is applicable to any sheet material handling system in which sheet stack registration in an accumulator is desirable, the imaging system 10 is herein illustrated as a low profile printer 12 including an accumulator, here shown as a paper output tray 14. The paper output tray 14 is coupled to the printer 12 to permit output of sheets of paper 16. Above the paper trays is a single sheet feed door 18, which is provided in addition to an automatic infeed mechanism (not shown). The top of the printer has an access door 20 for clearance of paper jams and the like when entry to the interior of the printer 12 is required. While this invention is described in terms of paper and paper sheets, it is intended that the invention encompass any sheet material which may be handled as individual or continuous sheets of such sheet material.

Figure 2:
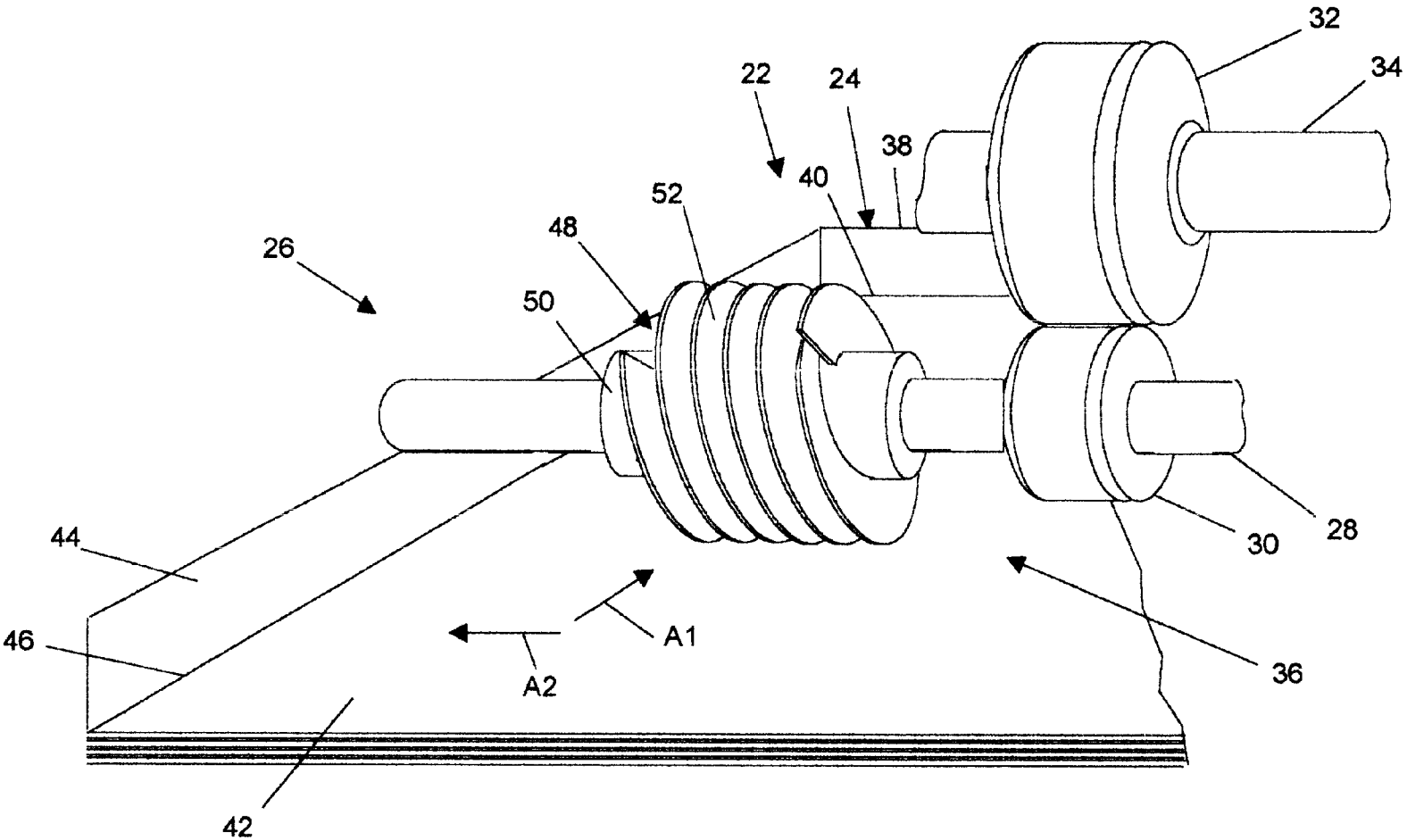
FIG. 2 is a schematic illustration of a roller assembly and accumulator incorporating a registration assembly in accordance with the principles discussed herein.

As seen in FIG. 2, the imaging system 10 includes an accumulator 22 including a tray 24 for receiving sheet material. A roller assembly 26 is provided to transport individual sheets of material into the tray 24. The roller assembly 26 includes a primary drive shaft 28 upon which is mounted one or more suitable drive members, such as a drive roller 30. The drive roller 30 is mounted in driving engagement with a driven or "back-up" roller 32, which is mounted on a secondary shaft 34.

A registration assembly 36 includes a lateral fence 38 extending along a first edge of the accumulator 22. The lateral fence 38 is adapted to contact a lateral edge 40 of sheets 42 fed into the accumulator 22. A longitudinal fence 44 extends along a second edge of the accumulator, and is substantially perpendicular to the lateral fence 38. The longitudinal fence 44 is adapted to contact a longitudinal edge 46 of the sheets 42 fed into the accumulator 22.

The registration assembly 36 also includes a helical registration member 48 adapted for rotation with the registration assembly 36. In the illustrated example, the helical registration member 48 is shown mounted on the shaft 28, but it is also contemplated that the helical registration member 48 could be mounted on a parallel driven shaft. The helical registration member 48 is mounted in contact with the sheet material 42 entering the accumulator 22. Rotation of the helical registration member 48 with the roller assembly 36 causes the helical registration member 48 to exert a force to urge each sheet of material entering the accumulator 22 toward the lateral fence 38 and the longitudinal fence 44 of the accumulator 22, as indicated by arrows A1 and A2.

The helical registration member 48 can include a cylindrical core member 50, with a helical contact surface 52 extending radially from the cylindrical core member 50. The helical registration member 48 can be fabricated from an elastomeric material, such as urethane and the like. The dual-directed force indicated by arrows A1 and A2 is attributable to the geometry of the helical contact surface 52, as defined by the angle $\Psi$. The angle $\Psi$ is selected such that the components of force are set to compensate the frictional forces of the sheet material being registered. The material and geometry of the helical registration member 48 should be chosen to permit the helical registration member 48 to overcome the frictional forces between the sheet of material to allow the sheets to slide into position, but then to leave the sheets undisturbed once they are registered in contact with the lateral and longitudinal fences.

Figure 3:
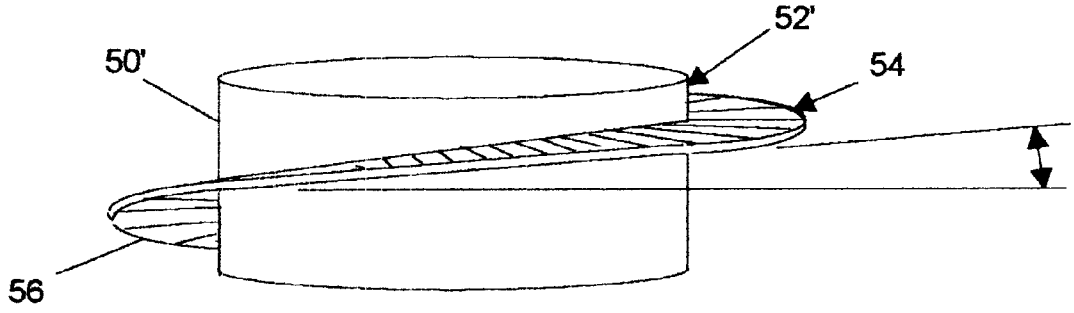
FIG. 3 is a schematic illustration of an alternative embodiment of a helical registration member.

As shown in FIG. 3, the helical contact surface 52' can be provided as a plurality of part-helical contact sections 54. The part-helical contact sections 54 comprise a plurality of radially extending fingers 56 aligned in a spiral around the cylindrical core 50'.

Figure 4:
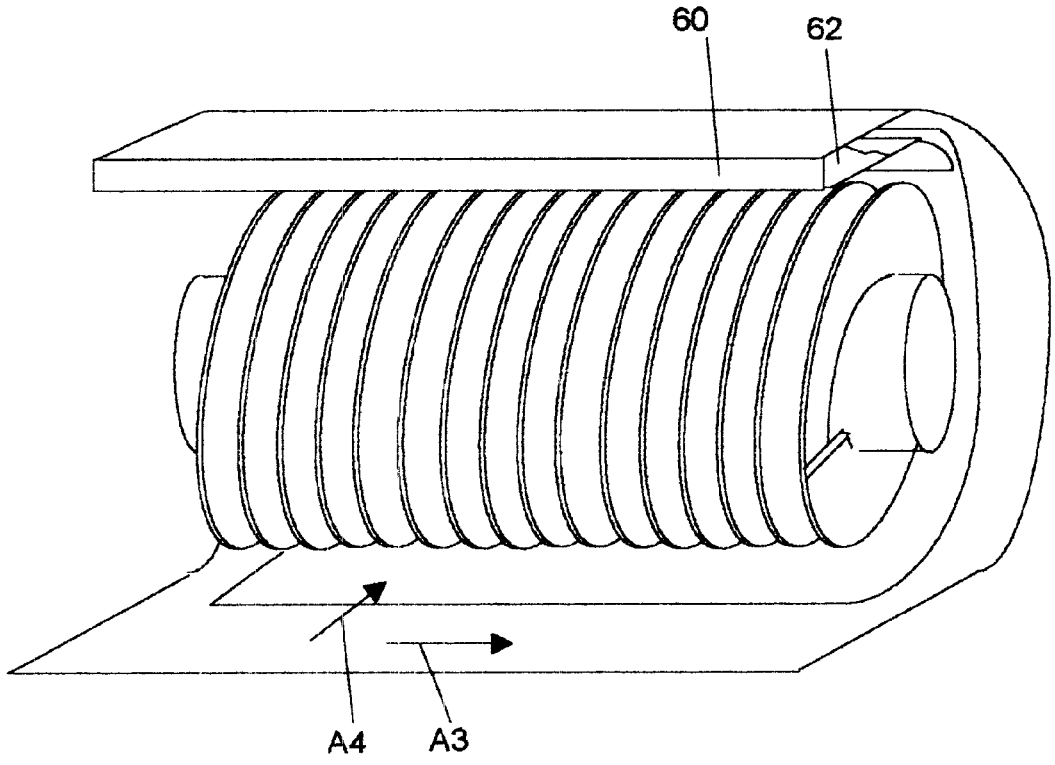
FIG. 4 is a schematic perspective view illustrating operation of the registration assembly in an alternative material feed path.

FIG. 4 illustrates the principles of the present invention implemented in a "circular path" configuration. The details of this configuration are more fully set forth in U.S. Pat. No. 6,251,054 B1 titled "Registration Of Paper In A Curved Paper Path", issued Jun. 26, 2001, the specification of which is Incorporated by reference herein The circular path is especially well-suited in the creation of multi-page documents such as booklets, and reduces the cost and footprint of imaging systems in which it is incorporated The FIG. 4 helical registration member 48' incorporates a "left-hand" helix, urging the sheets 58 toward the lateral fence 60 and the longitudinal fence 62 in the directions of arrows A3 and A4. The longitudinal fence 62 has been partially broken away for clarity of illustration.

It can thus be seen that the present invention significantly simplifies sheet registration by comparison to known jogger-type mechanisms, thereby reducing costs of manufacture and maintenance and increasing reliability. Although the present invention has been described with reference to specific embodiments, those of skill in the art will recognize that changes may be made thereto without departing from the scope and spirit of the invention as defined by the appended claims.

What is claimed is:

1. In an imaging system in which sheets are guided into an accumulator, a sheet registration system comprising the following:

a lateral fence extending along a first edge of the accumulator, the lateral fence adapted to contact a lateral edge of sheets fed into the accumulator;

a longitudinal fence extending along a second edge of the accumulator, the longitudinal fence adapted to contact a longitudinal edge of sheets fed into the accumulator; and a helical registration member mounted in contact with sheets entering the accumulator, the helical registration member rotatable about an axis substantially perpendicular to a direction of motion of sheets entering the accumulator.

2. A sheet registration assembly according to claim 1; wherein the helical registration member comprises the following:

a cylindrical core member; and a helical contact surface extending radially from the cylindrical core member.

3. A sheet registration assembly according to claim 2, wherein the helical registration member is fabricated from an elastomeric material.

4. A sheet registration assembly according to claim 3, wherein the helical registration member is fabricated from urethane.

5. A sheet registration assembly according to claim 2, wherein the helical contact surface comprises a plurality of part-helical contact sections.

6. A sheet registration assembly according to claim 5, wherein the part-helical contact sections comprise a plurality of radially extending fingers aligned in a spiral around the cylindrical core member.

7. A sheet registration assembly In a printer, the sheet registration assembly comprising the following:

an accumulator adapted to receive a plurality of sheets in a stack;

a lateral fence extending along a first edge of the accumulator, the lateral fence adapted to contact a lateral edge of sheets fed into the accumulator;

a longitudinal fence extending along a second edge of the accumulator, the longitudinal fence adapted to contact a longitudinal edge of sheets fed into the accumulator; and a helical registration member mounted in contact with sheets entering the accumulator, the helical registration member rotatable about an axis substantially perpendicular to a direction of motion of sheets entering the accumulator.

8. A sheet registration assembly according to claim 7, wherein the helical registration member comprises the following:

a cylindrical core member; and a helical contact surface extending radially from the cylindrical core member.

9. A sheet registration assembly according to claim 8, wherein the helical registration member is fabricated from an elastomeric material.

10. A sheet registration assembly according to claim 9, wherein the helical registration member is fabricated from urethane.

11. A sheet registration assembly according to claim 8, wherein the helical contact surface comprises a plurality of part-helical contact sections.

12. A sheet registration assembly according to claim 11, wherein the part-helical contact sections comprise a plurality of radially extending fingers aligned in a spiral around the cylindrical core member.

13. In an imaging system in which sheets are guided into an accumulator, a method of improving sheet registration, the method comprising the following steps:

providing a lateral fence extending along a first edge of the accumulator;

providing a longitudinal fence extending along a second edge of the accumulator, the longitudinal fence being substantially perpendicular to the lateral fence;

mounting a helical registration member in contact with sheets entering the accumulator;

rotating the helical registration member about an axis substantially perpendicular to a direction of motion of sheets entering the accumulator to urge each sheet entering the accumulator toward the lateral fence and the longitudinal fence of the accumulator.

14. A method according to claim 13, wherein the step of mounting a helical registration member comprises mounting a cylindrical core member with a helical contact surface extending radially from the cylindrical core member.

15. A method according to claim 13, wherein the helical registration member is fabricated from an elastomeric material.

16. A method according to claim 15, wherein the helical registration member is fabricated from urethane.

17. A method according to claim 13, wherein the step of mounting a helical registration member comprises mounting a helical registration member having a helical contact surface including a plurality of part-helical contact sections provided as plurality of radially extending fingers aligned in a spiral around the cylindrical core member.

* * * * *